US005385303A

United States Patent [19]

Gosselin et al.

[11] Patent Number: 5,385,303

[45] Date of Patent: Jan. 31, 1995

[54] ADJUSTABLE AEROSOL SPRAY PACKAGE

[75] Inventors: Peter G. Gosselin, Cincinnati, Ohio; William D. Benge, Covington, Ky.

[73] Assignee: The Procter & Gamble Company, Cincinnati, Ohio

[21] Appl. No.: 135,236

[22] Filed: Oct. 12, 1993

[51] Int. Cl.[6] ..... B05B 1/16; B65D 83/28

[52] U.S. Cl. ..... 239/394; 239/391; 222/153; 222/402.17

[58] Field of Search ..... 239/337, 390, 391, 396, 239/397, 436, 442, 443, 392–394; 222/153, 402.17

[56] References Cited

U.S. PATENT DOCUMENTS

| | | | |
|---|---|---|---|
| 2,209,960 | 10/1965 | Green | 222/394 |
| 2,887,273 | 5/1959 | Anderson et al. | 222/402.17 |
| 3,083,872 | 4/1963 | Meshberg | 222/42 |
| 3,176,888 | 4/1965 | Focht | 222/402.17 |
| 3,180,536 | 4/1965 | Meshberg | 222/402.17 |
| 3,206,082 | 9/1965 | Green | 222/394 |
| 3,231,153 | 1/1966 | Green et al. | 222/394 |
| 3,292,827 | 12/1966 | Frangos | 222/402.24 |
| 3,298,611 | 1/1967 | Marraffino et al. | 239/305 |
| 3,703,994 | 11/1972 | Nigro | 222/402.17 |
| 3,711,030 | 1/1973 | Jones | 222/402.17 |
| 3,795,366 | 3/1974 | McGhie et al. | 222/402.17 |
| 3,843,030 | 10/1974 | Micallef | 222/554 |
| 3,861,570 | 1/1975 | Green | 222/402.17 |
| 3,863,816 | 2/1975 | Focht | 222/402.17 |
| 4,125,226 | 11/1978 | Nieuwkamp | 239/468 |
| 4,257,560 | 3/1981 | Diamond | 239/337 |
| 4,311,256 | 1/1982 | DeArmitt | 222/321 |
| 4,405,064 | 9/1983 | Stoody | 222/148 |
| 4,433,799 | 2/1984 | Corsette | 222/309 |
| 4,454,964 | 6/1984 | Sacher | 222/43 |
| 4,946,069 | 8/1990 | Fuchs | 222/43 |

FOREIGN PATENT DOCUMENTS

| | | | |
|---|---|---|---|
| 1445029 | 8/1976 | United Kingdom | 222/402.17 |
| WO93/15845 | 8/1993 | WIPO . | |

*Primary Examiner*—Karen B. Merritt

*Attorney, Agent, or Firm*—Michael E. Hilton; John M. Howell; Ronald W. Kock

[57] ABSTRACT

The present invention relates to aerosol spray packages having a plurality of spray settings each having been optimized in terms of flow rate, particle size and spray pattern for a particular use. These spray characteristics are created by individual selection of the flow rate and nozzle parameters for each setting. Selecting the spray is easy and convenient to use.

3 Claims, 5 Drawing Sheets

ADJUSTABLE AEROSOL SPRAY PACKAGE

FIELD OF THE INVENTION

The present invention is for an aerosol spray package having more than one setting to allow a user to manipulate the package in order to produce a spray having desirable characteristics for a particular use. The means to select the desired spray is easy and convenient to use. This invention may be particularly beneficial in context of personal care products wherein the character of the spray may have a strong influence on the efficacy of the product being dispensed.

BACKGROUND

Liquid spray dispensers of various types, particularly aerosol and pump dispensers, are well known in the art. Aerosol dispensers use a pre-charged gaseous propellant to pressurize the contents of the package and deliver a product spray when an actuating means is triggered by the user. Aerosol dispensing systems are often preferred over manually actuated pump systems in many cases because these systems deliver a continuous spray of product which requires little energy to dispense, facilitate easy control of the delivery of product, and typically procure finer sprays than from manually activated pump systems due to the higher pressure. Examples of application of aerosols sprayers include spray paints, deodorants, hair sprays, adhesives, disinfectants, and air fresheners.

One problem associated with aerosol packages using a single nozzle for dispensing said product is a limitation of the product use. For example, a nozzle designed for covering large surface areas may not be desirable for covering small surface areas. Such a situation results in wasting large mounts of product, as well as covering objects not intended to be covered with the over spray. The reverse situation is similarly not desired, i.e. the nozzle designed for narrow concentrated sprays will not adequately cover large surface areas, and may overwet the surfaces it does cover, resulting in running of the product.

These problems have been addressed by packaging engineers by tailoring nozzles to provide the widest use for a given aerosol product. Tailoring may involve modifications to the nozzle, particularly the spray pattern or cone angle of the spray, the size of the liquid particles or droplets comprising the spray, and the delivery rate of the spray.

The spray pattern diameter or cone angle is visually observable from the shape of the spray as it exits the nozzle of the package. The spray pattern diameter is determined by several factors, the most important being the key nozzle parameters and the rate of the product flow through the nozzle, For a given product flow rate, a nozzle can be configured, typically by adjusting the exit orifice diameter and length to deliver a specific spray pattern diameter. A more through discussion regarding such parameters is found in A. H. Lefebvre, *Atomization and Sprays*, Hemisphere Publishing, New York, N.Y.; herein incorporated by reference.

The mean particle size of the spray is likewise discernible and is often characterized on the gross level as either a fine or course spray. Spray particles are formed as the liquid exits the spray nozzle as a conical sheet of liquid, wherein it breaks up in pieces as the liquid sheet interacts with the surrounding air. Engineers can design a nozzle to have a desirable particle size for the flow passing through it by adjusting various dimensions within the nozzle. These adjustments include, but are not limited to, swift chamber diameter, and the length, width, and taper of the tangential ports which feed the swift chamber. By selection of the dimensions, a nozzle can be designed for a specific flow rate to deliver a specific means particle size. Further discussion regarding this subject is found in A. H. Lefebvre, *Atomization and Sprays*; previously incorporated by reference.

The delivery rate of the spray, hereinafter referred to as spray rate, is harder to visually observe, but, is readily discernible to users of spray products in terms of overwetting or underwetting the object being sprayed with the product. Underwetting or overwetting is a result of lack of control of the product flux which is defined as the mount of the product delivered in grams(g), over a period of time in seconds (see), covering an area in square centimeters (cm2), or (g/see/cm2). The product flux is effected by a number of factors, most importantly the rate of product delivered from the pressurized container. As spray rate is increased, the product flux is increased and can lead to overwetting conditions. Similarly, as spray rate is decreases the product flux is decreased which can lead to underwetting conditions.

In summary the sprays produced by the claimed aerosol package are optimized in terms spray pattern, particle size and spray rate therein providing the user with a package having a variety of optimized uses.

DISCUSSION OF THE PRIOR ART

Aerosol containers are typically fitted with a single spray nozzle that produces a spray having a single set of spray characteristic. Although good for general use of said product, aerosol containers were subsequently developed to provide the user with a choice of sprays, each having different characteristics applicable for a variety of uses. Such aerosol packages generally have a plurality of spray orifices or nozzles which are aligned with a common delivery port to modify the spray. Such sprayers include those disclosed in U.S. Pat. No. 3,083,872, to Meshberg, issued Apr. 2, 1963. Meshberg discloses aerosol spray packages comprising a mounting member having a multiple of spray nozzles wherein an individual spray nozzle is selectively aligned with a common passage in said mounting member to control the spray pattern of material sprayed on a surface. Although such a package may provide options in context of the spray pattern, said package is incapable of modifying the flow rate of liquid to the nozzle. Therefore, although both the pattern, and to some extent the particle size may be selected by the user, the flow rate of said spray is not adjustable. This package, therefore, may not provide the desired spray characteristics for adequate coverage over a particular area.

Aerosol packages having flow rate adjustment are known in the art. U.S. Pat. No. 3,231,153, to Green et at., issued Jan. 25, 1966, discloses an aerosol spray package providing a means to adjust the flow rate to a single spray nozzle by providing a spray actuator wherein the rate of product deliver to the nozzle is commensurate with the amount of finger pressure applied to said actuator. This allows for the selection of the flow rate from the nozzle without having to put the package down to rearrange the parts of the sprayer. Although no special construction of the spray head or valve housing is required, a sophisticated aerosol valve having a telescopically arranged dual plunger is required. U.S. Pat. No. 3,292,827, to Frangos, issued Dec. 20, 1966, discloses a variable flow rate aerosol package wherein the flow rate is determined by the depth of the valve stem in the container. The flow rate is increased when the stem is deeply inserted in said container since a greater number of holes in the stem is made available to the product in said container.

A third line of prior art discloses aerosol packages designed to deliver a metered dose at one spray setting, and a continuous spray at a second setting. U.S. Pat. No. 3,180,536 Meshberg, issued Apr. 27, 1965 discloses a spray package having a means to provide a metered dose as well as an additional feature to vary the cone angle. Said feature comprises a spray head having multiple spray nozzles wherein when the valve is in the position of a metered dose, the valve releases a predetermined volume of product at a flow rate determined primarily by the valve geometry and the propellant vapor pressure. When said valve is in the continuous flow setting, the product is allowed to flow continuously from the can reservoir until the valve is released at a flow rate defined by the same valve and the same vapor pressure in the can. Therefore, only the time over which the product will flow is varied between positions, and there is no actual means provided for varying the actual flow rate at the metered dose position as compared to the continuous flow position.

Based on the art as exemplified above, an artisan may design a package having a single flow rate, and a group of nozzles that all create sprays, however, none of the nozzles are capable of producing sprays optimized for spray characteristics such as particle size, spray pattern and spray rate. Alternatively, one may choose a single nozzle to produce an optimized spray, but the other nozzle settings will not produce optimized spray characteristics since the flow rate cannot be changed. On the other hand, an artisan could design a single-nozzle package having a means to vary the flow rate. However, since the nozzle specified produces optimum spray characteristics at a single flow rate setting, as the flow is varied over its range of adjustment, the resulting sprays will be less than optimal. For example, when changing from a wide dispersion nozzle with a flow rate ideally suited for said nozzle to a narrow dispersion nozzle, the flow rate should also be lowered to avoid undesirable overwetting of the object sprayed. Conversely, when switching from a narrow angle nozzle to a wide angle nozzle, the flow rate should be increased allowing the product to be distributed evenly over a much larger area, and avoid underwetting of the object being sprayed. The aforementioned art does not provide such an option.

Therefore, an aerosol spray package having different nozzles and flow rates at each setting to provide optimized spray characteristics at each setting would be advantageous. Such a package was not currently available in the art.

OBJECTS OF THE INVENTION

It is the primary object of the invention to provide an aerosol delivery system wherein the package offers a selection of spray settings each having an optimized spray pattern, particle size, and flow rate.

It is another object of the invention to provide a spray head which is easily attachable to a conventional aerosol container having a conventional single orifice outlet valve.

It is another object of the invention to provide a simple means for changing the spray nozzle and the flow rate

SUMMARY OF THE INVENTION

The present invention is an aerosol spray package able to be manipulated by the user to select a spray having specific characteristics. Said package comprises:

a. a sealable, container capable of being pressurized with a gas;

b. a valve cup attached to said container having a central aperture;

c. an aerosol valve extending from the interior of said container through said valve cup central aperture wherein a valve stem extends from the top of said aerosol valve;

d. an adapter comprising a rigid tubular piece affixed to said container, said rigid tubular piece extending upward from said valve cup within which said valve stem resides;

e. a spray selector in communication with the valve cup and fitting over said tubular piece, said spray selector comprising a means for selecting an individual spray nozzle from a plurality of nozzles each nozzle capable of producing a unique spray pattern, and particle size, and a means to adjust the flow rate from said valve to said nozzles; and f. an actuation means for completely opening and closing said aerosol valve said means providing fluid communication between said spray nozzle and said container.

The present invention provides the end user with an aerosol package wherein the user can select a spray nozzle for use wherein each nozzle may have a unique set of characteristics such as spray pattern, mean particle size, and flow rate.

DETAILED DESCRIPTION OF THE INVENTION

Figure 1:
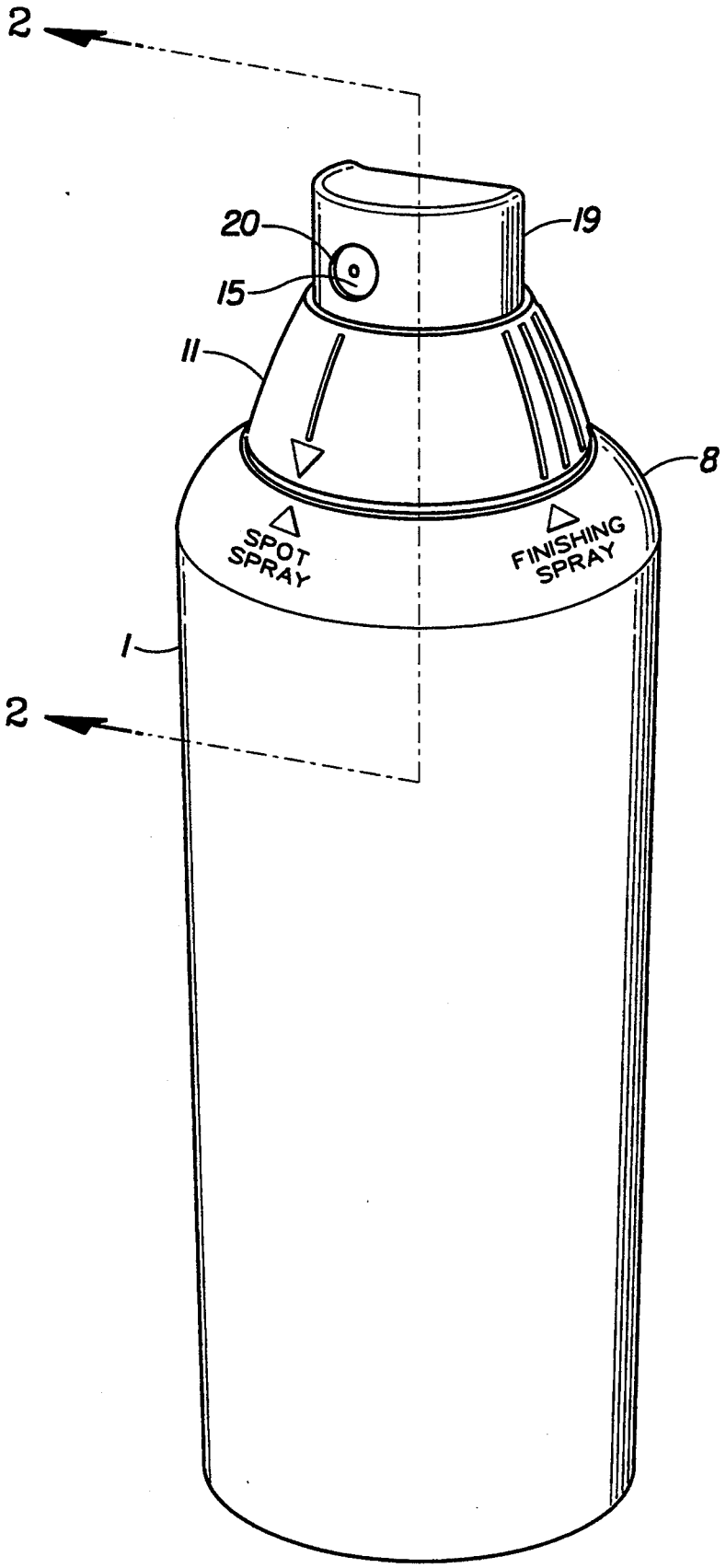
FIG. 1 is a perspective view of the spray package.
Figure 2:
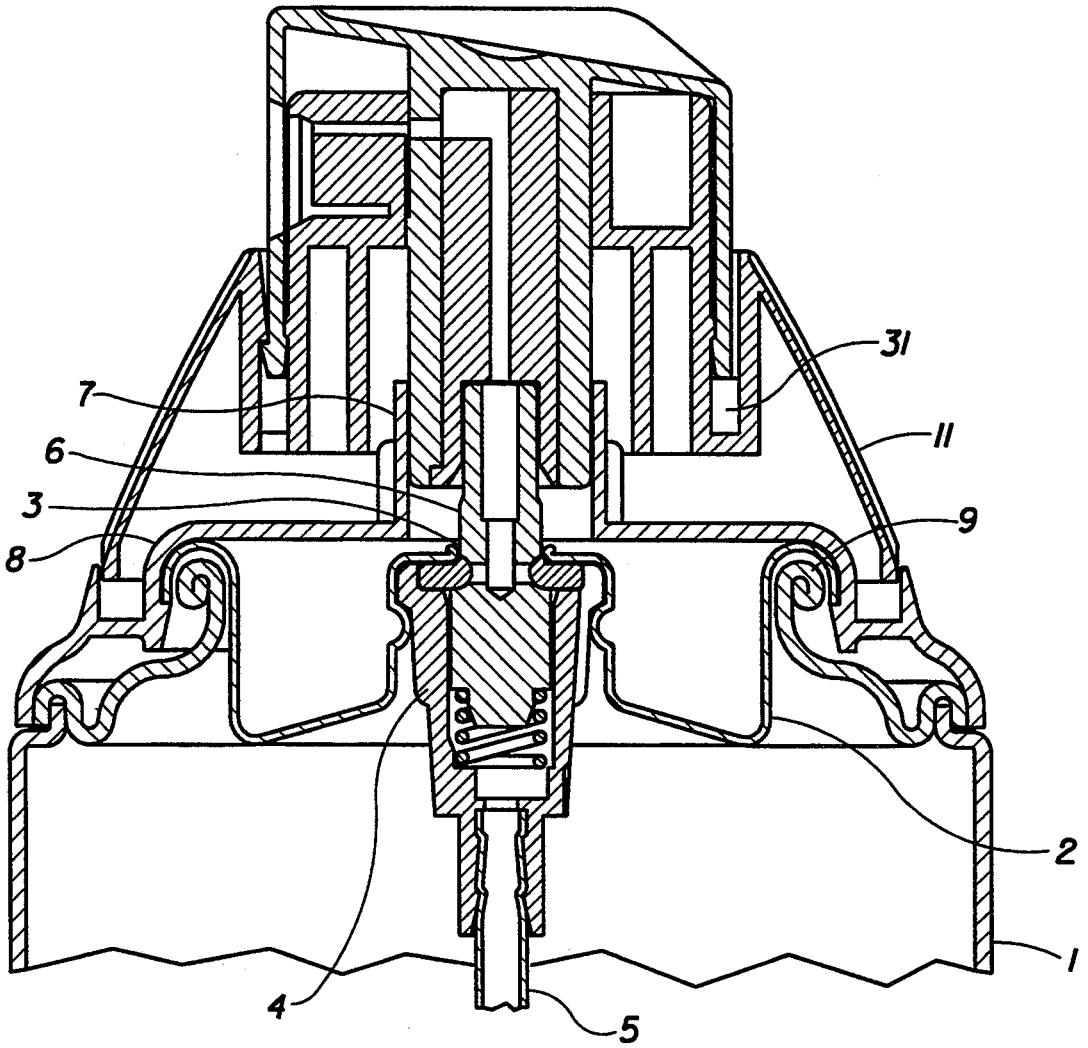
FIG. 2 is a cross-sectional view of the spray package assembly.

FIG. 1 shows a perspective view of a preferred embodiment of the present invention. FIG. 2 is a sectional view of the aerosol package of FIG. 1. FIG. 2 shows container 1 having valve cup 2 attached to the top of said container. The container is like those routinely used in the art and is available from a variety of manufacturers such as U.S. Can, Inc. Such containers can be made of any rigid material such as metal or plastic capable of being pressurized. Specific examples of materials capable of being used herein are tin, aluminum, polyethylene, and polypropylene. The container and valve cup may be integrally formed.

Said valve cup has an central aperture 3 wherein a standard aerosol valve 4 is seated. Such valve cup assemblies are commonly known in the art and are available from a variety of manufactures such as Perfect Valois Ventil. Said aerosol valve comprises a dip tube 5 extending from the valve assembly and a valve stem 6 emerging from the top of said aerosol valve, perpendicular to said top of said container. An adapter comprising a rigid tubular piece is attached to said container by any means which eliminates axial rotation of said tubular piece. FIG. 2 shows a snap-on adapter 8 comprising tubular piece 7 engaged with the external rim 9 of said valve cup's container seam. Said tubular piece 7 is rigid and made from a relatively non-deformable metal or plastic such as steel, aluminum, polyethylene or polypropylene. Said tubular piece should be of such a dimension to provide adequate strength to withstand the rigors of use.

Figure 3:
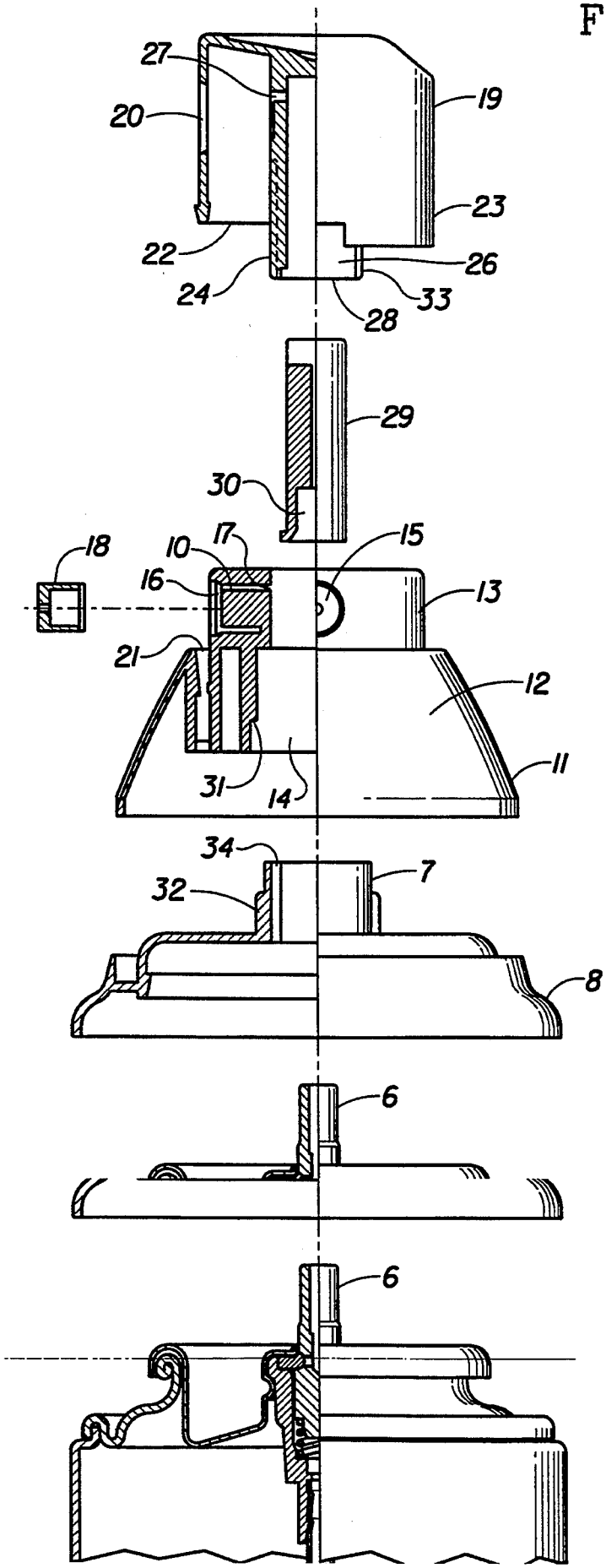
FIG. 3 is an exploded quarter-sectional view of the spray assembly.

FIG. 3 shows spray selector 11 comprising a lower portion 12 and upper portion 13. Said upper and lower portions are joined and move in unison relative to each other. Preferably, said upper and lower portions are integrally formed wherein said upper portion is preferably smaller than that of the lower portion providing an aesthetically pleasing shape to the package. More preferably said spray selector has an annular shape as shown in FIG. 1 wherein said lower portion 12 is a thumbwheel having a grippable surface in order to facilitate rotation of said thumbwheel with finger pressure, and the upper portion 13 is a turret. FIG. 3 shows said spray selector having a vertical opening 14 completely through its central axis. The spray selector is in communication with top of said container, either directly contacting said container, or more preferably contacting the adapter 8 attached to said container. FIG. 2 shows said spray selector 11 in contact with an adapter 8 attached to said container. Said spray selector has an vertical opening through the central axis of said spray selector. Said vertical opening preferably has an annular shape. Said tubular piece 7 resides in said spray selector vertical opening.

FIG. 3 shows upper portion 13 having a plurality of spray nozzles 15 residing in a nozzle seat 16 around the periphery of said spray selector. Said nozzles are in fluid communication with said vertical opening of said spray selector by a plurality of corresponding windows 17 on said nozzle seat's wall adjoining the inside diameter wall of said vertical opening. The spray nozzles of the present invention are inserted into the nozzle seats in the upper portion wherein said nozzles are in fluid communication with said vertical opening in said spray selector through said window in said nozzle seat. Said nozzles are commonly known and used in the art, and are available from Seaquist Dispensing Inc. Each nozzle is selected based on its unique exit orifice and or nozzle internal geometry which is prescribed to deliver a specific set of spray properties for a given flow rate. Preferred nozzles used in the present invention comprise insert 18 and a center post 10 attached to the walls of said nozzle seat 16. Said insert comprises a hollow cylinder having a closed end with an exit orifice and an opposite end that fits over said center post. Said insert has a means for increasing the velocity to said spray passing through said nozzle. Said means comprises grooves in said closed end of said cylinder to form a fluid swift chamber, not shown. The inserts of the present invention may have additional grooves on the lateral walls of said cylinder.

The present invention has an actuation means in communication with said spray selector's upper portion. Said actuator effectuates the opening of said aerosol valve when sufficient downward finger pressure is applied to said actuation means. FIG. 3 shows said actuating means 19 comprising a relatively flat surface facing upward with a second surface facing downward having a hollow post 24 attached to the center of said second surface. Said hollow post 24 extends downward and through said vertical opening 14 of said spray selector. Said hollow post extends through said upper portion of said spray selector and travels up and down inside said tubular piece. A preferred embodiment of the present invention shown in FIG. 3 is where the actuation means 19 comprises a cylindrical spray button fitting over a complementary upper portion of the spray selector 13. Said spray button has port 20 in the side wall of said button wherein when aligned with any one of said spray nozzles, provides an opening from which said spray is discharged from the selected nozzle. The presence of a nozzle within said port is easily observable by said user, thereby signaling the user that the package is in capable of being sprayed. This signal can be supplemented with an additional means to designate which type of spray will be evolved from each nozzle when actuating the container. For example, an arrow may be inscribed on the lower portion of said spray selector which in turn points to an inscription on the top of the container describing the spray as a broad fine mist, or a narrow concentrated spray.

The above mentioned spray button and spray selector rotate relative to each other; i.e. when rotating the lower portion of the spray selector the upper portion rotates inside said spray button. Said spray button and spray selector also move up and down together. Upon applying sufficient downward finger pressure, said spray button and said spray selector move downwardly together wherein the aerosol valve is opened. Said button returns to its pre-actuated position by the spring compression of said aerosol valve. The actuator's downward travel length is limited in off position such that the valve cannot be opened. The means to achieve this is shown in FIG. 3 wherein said means comprise a series of stops 31 attached to the walls of the vertical opening 14 of said spray selector 11. Said stops are in alignment with cooperating vertical stops 32 on the exterior surface of said tubular piece 7 when in the off position. In a preferred embodiment of the present invention, said spray button's downward motion is restricted when said button is any position other than when the nozzle is aligned with said port.

FIG. 3 shows annular pocket 21 formed between said upper portion 13 and said lower portion 12. The base 22 of the outer wall of said spray button 19 fits into annular pocket 21. The bottom edge of this annular pocket contains two shoulders, not shown, radially spaced apart, preferably about 180°. An extended segment 23 of said push button rotates between these shoulders allowing the lower portion 12 to rotate only a fixed distance, preferably about 90°, relative to the stationary push button. In a preferred embodiment, two spray nozzles are radially located about 90° apart on the outside diameter of the upper portion.

FIG. 3 shows said hollow post 24 attached to said actuator's second surface. Preferably said post is attached to the center of said second surface, and more preferably integrally formed with said second surface. Said hollow post extends downward through said vertical opening 14 of said spray selector emerging from said upper portion 13. Said hollow post moves up and down within said tubular piece to provide fluid communication between said nozzles and said aerosol valve. Said hollow post engages said tubular piece 7 at the opposite end that is attached to said actuator. Said means of engagement between said hollow post and tubular piece does not restrict the axial movement up and down of said hollow post inside said tubular piece. However, said engagement means eliminates essentially all rotational movement of said post within said tubular piece. FIG. 3 shows an engagement means comprising a series of vertical splines 33 on the exterior surface of said hollow post 24 and a series of cooperating vertical groves 34 on the interior surface of said tubular piece 7. Alternative engagement means includes a hollow post having a non-circular shaped cross section which fits in a tubular piece having essentially the same cross-sectional shape. The hollow post fits inside said tubular piece to prevent rotating of said hollow post.

Figure 4A:
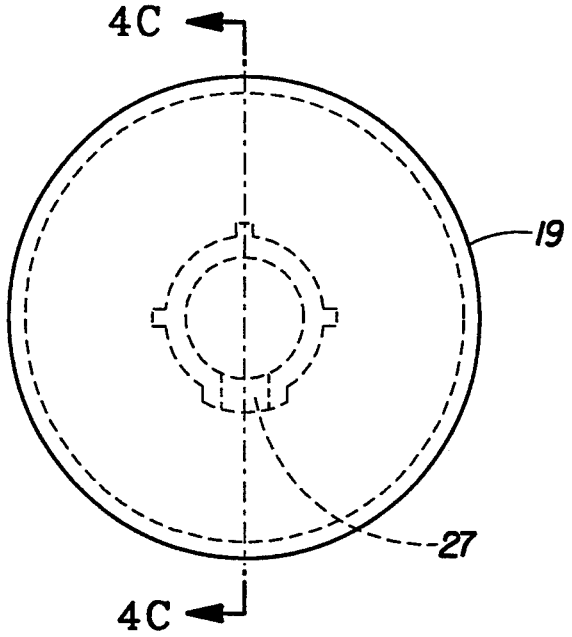
FIG. 4A is an overhead view of the spray button.
Figure 4B:
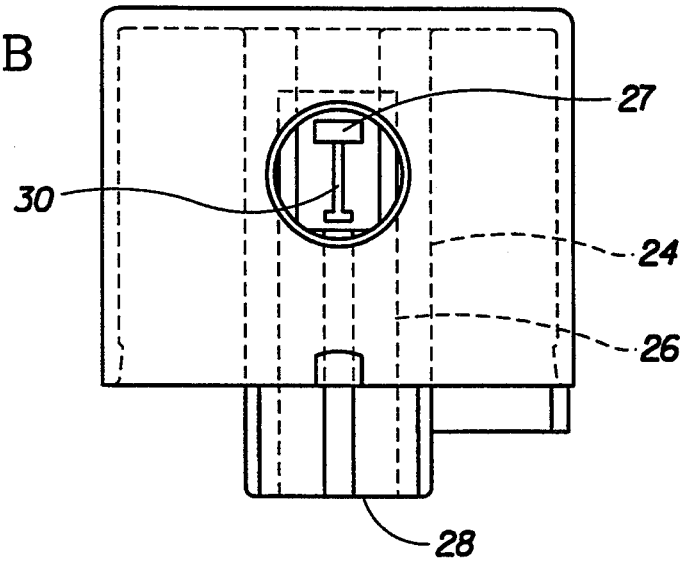
FIG. 4B is a frontal view of the spray button.
Figure 4C:
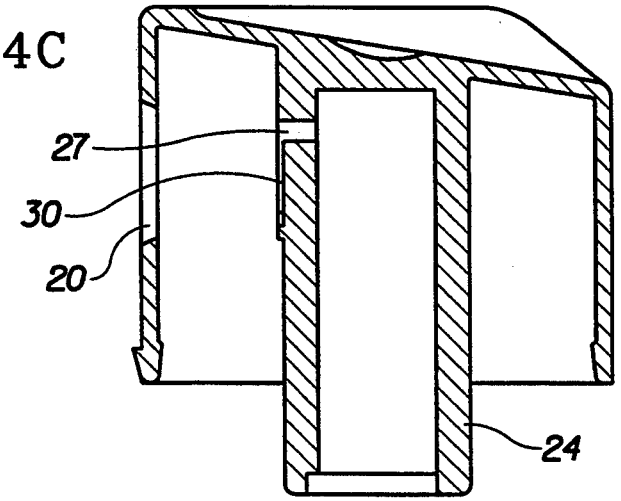
FIG. 4C is a cross-sectional view of the spray button.

FIG. 4B shows said hollow post 24 attached to said second surface of said button. Said post comprises channel 26 running axially through said post wherein said channel connects opening 27 on the lateral face of said hollow post at the end of said post nearest to the spray button, and a transverse opening 28 in the end of said post closest to said valve stem. Said opening 27 on the lateral face of said post is at a height corresponding to said window 17 in back wall of the spray nozzle seat 16. When said post is inserted into said vertical opening, the surface area surrounding said opening 27 forms a tight seal with the walls of said spray selector's vertical opening preventing leakage of product.

Due to molding limitations, said hollow post 24 cannot be made with a channel volume small enough to prevent a delayed shut off effect which is created by excess propellant trapped inside said channel after closing the valve. This is particularly noticeable where small restrictions upstream of this volume exist resulting in longer time to bleed said channel. In order to eliminate this effect said hollow post has a pin inserted into the hollow post's channel, thereby minimizing the volume of said channel. FIG. 3 shows pin 29 which is inserted in said hollow post channel 26. Said pin has a cavity 30 at its end nearest the valve stem allowing said stem valve to reside in it.

Figure 5:
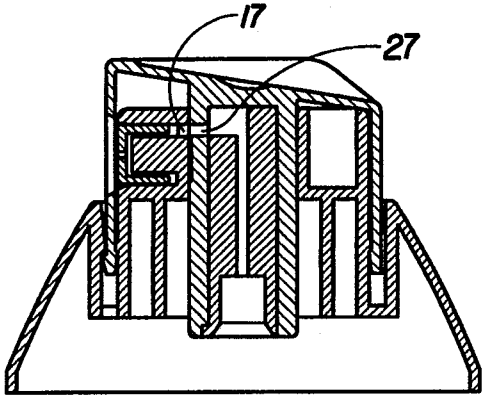
FIG. 5 is a cross-sectional view of the spray selector.
Figure 6:
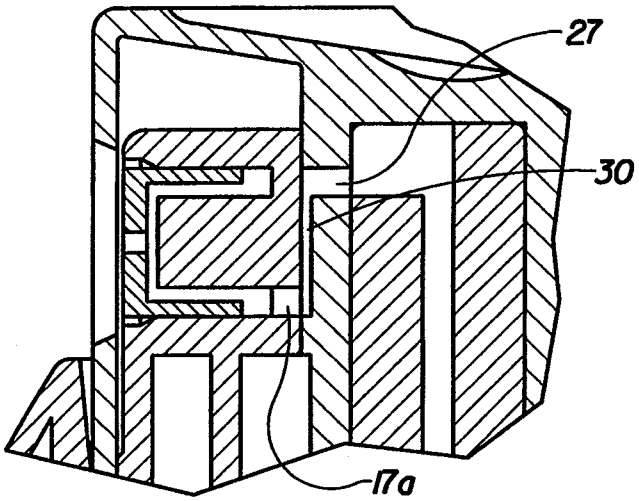
FIG. 6 is an enlarged view of a portion of FIG. 5 showing the window at the bottom of the spray insert seat.
Figure 7:
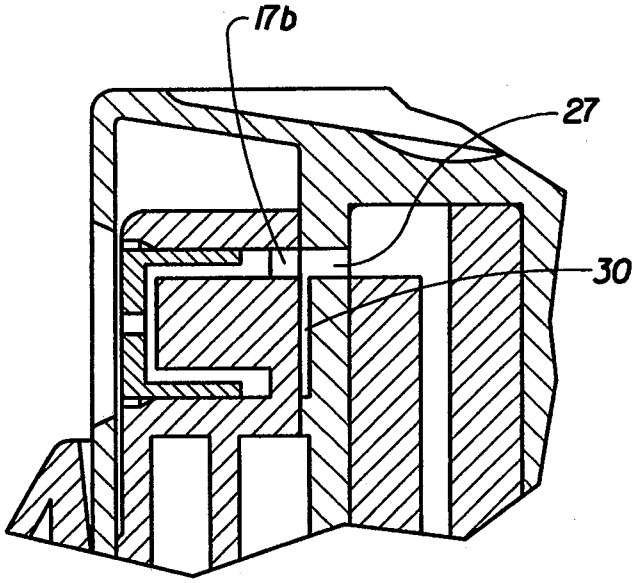
FIG. 7 is an enlarged view of a portion of FIG. 5 showing the window at the top of the spray insert seat.

The flow rate of the spray is individually set for each spray nozzle. As stated above, each spray nozzle is in fluid communication with the product by a window on rear wall of said spray nozzle seat in communication with the vertical opening of said spray selector. With said opening on the lateral face of said hollow post sealingly engaging the walls of said vertical opening, each window is in fluid communication with the container when the individual window is aligned with the opening of on the lateral face of said hollow post. Upon aligning said opening and said window, pressing said actuator releases product from said container through said hollow post exiting the opening on the lateral face of said post, through the window, and out the spray nozzle. The flow rate is directly proportional to the open area of said window. The greater the open area, the greater the flow rate, and the lesser the open area, the lesser the flow rate. The flow rate is varied by rotating said selector to align said windows having varying open area with the opening on the lateral face of said post. Flow rates can also be set for each spray nozzle through means other than varying the window's open area. For example, the flow can also be reduced as shown in FIG. 5, 6, and 7 wherein the window 17 behind each spray insert seat 16 in the spray selector are of equal size but are in different positions with respect to the insert seat 16. In one spray position (FIG. 6), the window **17*a* is at the bottom of said insert seat 16, in the other (FIG. 7) window 17*b* is at the top of the insert seat. A small slot 30 on the face of the spray button's hollow post provides fluid communication with said channel opening 27** of said hollow post and the window in said insert seat. In one spray position, said channel opening in the hollow post is directly aligned with said insert seat window, preferably located at the top of the insert seat. This would provide a relatively high spray rate to this insert. After rotating the spray selector about 90°, the spray button's channel opening communicates with the insert seat's window, preferably located at the bottom of said insert seat, by way of said slot on the face of the hollow post. The slot could be sized with a smaller cross sectional area to provide a relatively low flow rate to this insert. This configuration has manufacturing advantages in that excessively small windows, which are difficult to mold, could be avoided in situations requiting extremely low flow rates.

We claim:

1. An aerosol spray package capable of being manipulated by a user in order to obtain a spray having specific characteristics, said package comprising:

a) a sealable container capable of being pressurized with a gas, said container having an interior;

b) a valve cup attached to said container, said valve cup having a central aperture;

c) an aerosol valve extending from said interior of said container through said central aperture of said valve cup, said aerosol valve having a top and a valve stem extending from said top of said aerosol valve;

d) an adapter comprising a rigid tubular piece affixed to said container, said rigid tubular piece extending upward from said valve cup, so that said valve stem resides within said rigid tubular piece;

e) a sprays selector fitting over said rigid tubular piece and in communication with said valve cup, said spray selector comprising a means for selecting an individual spray nozzle from a plurality of spray nozzles, wherein each of said nozzles is capable of producing a unique spray pattern and particle size, said spray selector also comprising a means for adjusting a flow rate from said aerosol valve to said individual spray nozzle, said spray selector also being in communication with a top of said container, said spray selector comprising a lower portion and an upper portion joined together to move in unison relative to each other, and a vertical opening extending completely through a central axis of said spray selector; and f) an actuation means for completely opening and closing said aerosol valve, said actuation means providing fluid communication between said individual spray nozzle and said container.

2. An aerosol spray package according to claim 1 wherein said upper portion of said spray selector: has a periphery containing nozzle seats in which said plurality of spray nozzles reside, said nozzle seats having back walls with windows wherein, said nozzles being in fluid communication with said vertical opening of said spray selector through said windows in said back walls.

3. An aerosol spray package according to claim 1 wherein said actuation means comprises a relatively flat surface facing upward and a second surface facing downward, said second surface having a center and a hollow post attached to said center of said second surface wherein said hollow post extends downward into said vertical opening of said spray selector and travels up and down inside said tubular piece.

* * * * *